US010240766B1

(12) United States Patent
Woodworth

(10) Patent No.: US 10,240,766 B1
(45) Date of Patent: Mar. 26, 2019

(54) EXPANDABLE LED LIGHT BALL

(71) Applicant: Kenneth Woodworth, St. Johns, FL (US)

(72) Inventor: Kenneth Woodworth, St. Johns, FL (US)

( * ) Notice: Subject to any disclaimer, the term of this patent is extended or adjusted under 35 U.S.C. 154(b) by 0 days.

(21) Appl. No.: 15/795,233

(22) Filed: Oct. 26, 2017

(51) Int. Cl.

| | |
|---|---|
| ***F21V 21/00*** | (2006.01) |
| ***F21V 21/24*** | (2006.01) |
| ***F21V 21/15*** | (2006.01) |
| ***F21V 23/04*** | (2006.01) |
| *F21W 121/04* | (2006.01) |
| *F21Y 115/10* | (2016.01) |

(52) U.S. Cl.
CPC ..... *F21V 21/24* (2013.01); *F21V 21/15* (2013.01); *F21V 23/04* (2013.01); *F21W 2121/04* (2013.01); *F21Y 2115/10* (2016.08)

(58) Field of Classification Search
CPC ..... A63B 43/06; F21V 21/24; F21V 2121/00–2121/06
See application file for complete search history.

(56) References Cited

U.S. PATENT DOCUMENTS

2010/0110668 A1* 5/2010 Marlonia ..... F21V 21/15 362/152
2015/0077980 A1* 3/2015 Coughlin ..... F21V 21/14 362/183

* cited by examiner

*Primary Examiner* — Sean P Gramling
(74) *Attorney, Agent, or Firm* — Lev Ivan Gabriel Iwashko

(57) ABSTRACT

An expandable light emitting diode (LED) light system, including an expandable LED light ball, and a control box to control the expandable LED light ball.

5 Claims, 3 Drawing Sheets

EXPANDABLE LED LIGHT BALL

BACKGROUND OF THE INVENTION

1. Field of the Invention

The present general inventive concept relates generally to a light emitting diode (LED) ball, and mare specifically, to an expandable LED light ball.

2. Description of the Related Art

It is well known that Christmas tree lights wrapped around and within chicken wire to make spherical ornaments, are a commonly seen item during the holidays. However, these Christmas light balls tend to be very large and unable to be stored once the holidays are over, causing individuals to remove the lights and dispose of the otherwise useable spheres.

Therefore, there is a need for a device provides the aesthetics of the Christmas light balls, while allowing for easy storage thereof.

SUMMARY

The present general inventive concept provides an expandable LED light ball.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an expandable light emitting diode (LED) light system, including an expandable LED light ball, and a control box to control the expandable LED light ball.

The control box may include a winch cable connected to the expandable LED light ball, a winch to unwind and retract the winch cable, a motor to rotatably move the winch, and a motor control switch to control the motor and a direction in which the winch rotates.

The control box may further include a light control switch connected to the winch cable to control a color-changing of the expandable LED light ball.

The expandable LED light ball may include a plurality of LED molded links including a plurality of LED lights disposed thereon, and a plurality of converging points connected to various portions of the plurality of LED molded links.

The plurality of LED molded links may be expandable and contractable in an accordion-like manner.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE INVENTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
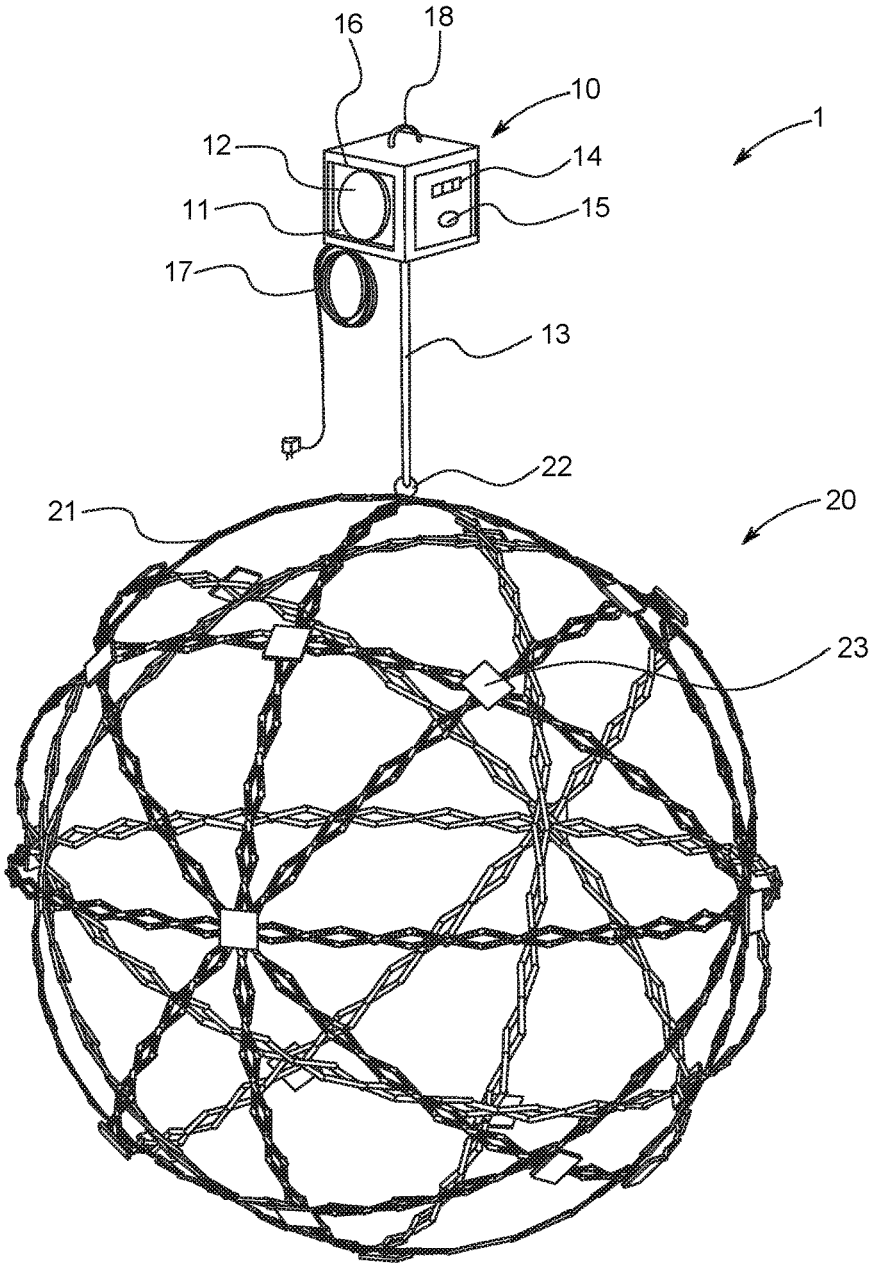
FIG. 1 illustrates an expandable LED light ball system, according to an exemplary embodiment of the present general inventive concept.

FIG. 1 illustrates an expandable LED light ball system 1, according to an exemplary embodiment of the present general inventive concept.

Referring to FIG. 1, the expandable LED light ball system 1 may include a control box 10 and an expandable LED light ball 20.

The control box 10 may include a motor 11, a winch 12, a winch cord 13, a winch control switch 14, a light control switch 15, a power source 16, a power cord 17, and an attachment portion 18.

The motor 11 may be any type of motor known to one of ordinary skill in the art, and may be powered by the power source 16, or alternatively, may be powered directly from the power cord 17 when it is plugged into an electrical socket.

When the motor 11 receives electrical power, the motor 11 may allow the winch 12 to rotate. If the winch 12 rotates in a first direction, the winch cord 13 may unwind. If the winch 12 rotates in a second direction, the winch cord 13 may retract.

The winch control switch 14 may be a three-way switch that has an OFF position that shuts off power to the motor 11, an UNWIND position that powers-on the motor 11 such that the winch 12 causes the winch cord 13 to unwind, and a RETRACT position that powers-on the motor 11 such that the winch 12 causes the winch cord 13 to retract into the control box 10. Alternatively, the winch control switch may be any combination of buttons, switches, knobs, dials, or any other type of mechanism that may power-on the motor 11. As such, the expandable LED light ball 20 may be raised and lowered based on the RETRACT position and the UNWIND position of the winch cord 13.

The light control switch 15 may be a button that has different settings for the expandable LED light ball 20. More specifically, if the light control switch 15 is pushed once, the expandable LED light ball 20 may shine with a white light. A subsequent push of the light control switch 15 may cause the expandable LED light ball 20 to blink with the white light. A subsequent push of the light control switch 15 may cause the expandable LED light ball 20 to shine with a yellow light. A subsequent push of the light control switch 15 may cause the expandable LED light ball 20 to blink with the yellow light. A subsequent push of the light control switch 15 may cause the expandable LED light ball 20 to shine with a red light. A subsequent push of the light control switch 15 may cause the expandable LED light ball 20 to blink with the red light. A subsequent push of the light control switch 15 may cause the expandable LED light ball 20 to shine with a blue light. A subsequent push of the light control switch 15 may cause the expandable LED light ball 20 to blink with the blue light. The same pushing procedure of the light control switch 15 may allow any other color not mentioned herein to be utilized, or multicolors could be utilized.

Alternatively, the light control switch 15 may be a dial that a user may turn to achieve a desired light color or light effect.

Although not illustrated here, the control box 10 may include an ON/OFF switch to allow power to be provided to the control box 10.

The winch cord 13 itself may include electrically conductive elements therewithin, such that power and information may be provided from the light control switch 15 to the expandable LED light ball 20. More specifically, the winch cord 13 allows the expandable LED light ball 20 to be connected directly to the light control switch 15.

The light control switch 15 may be powered by the power source 16, or alternatively, may be powered directly from the power cord 17 when it is plugged into an electrical socket.

The attachment portion 18 may be attached to a tree, ceiling, or any other high place, so that the control box 10 and the expandable LED light ball 20 may hang.

The expandable LED light ball 20 may include LED molded links 21, a ball attachment portion 22, and a plurality of converging points 23.

Figure 2:
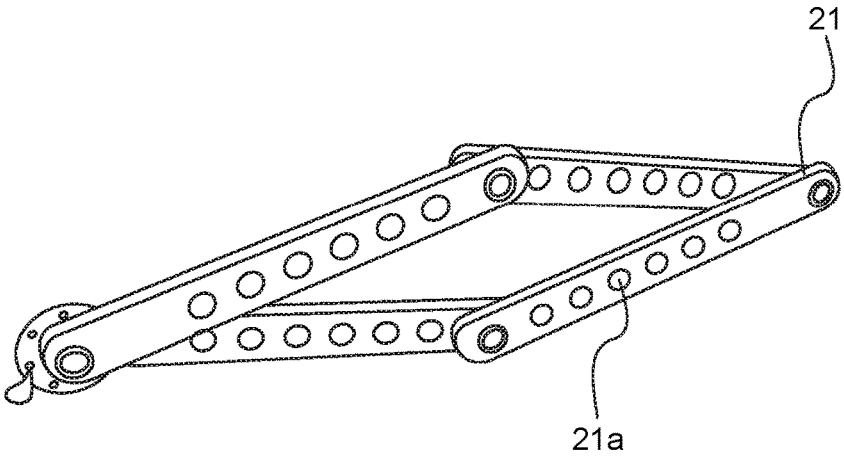
FIG. 2 illustrates a zoomed-in portion of a portion of the LED molded links, according to an exemplary embodiment of the present general inventive concept.

FIG. 2 illustrates a zoomed-in portion of a portion of the LED molded links 21, according to an exemplary embodiment of the present general inventive concept.

Referring to FIGS. 1 and 2, the LED molded links 21 may include a plurality of LED lights 21*a* disposed within or on the LED molded links 21. The LED lights 21*a* may all be interconnected such that all of the LED lights 21*a* are connected to and controlled by the light control switch 15 via the winch cord 13.

Alternatively, the LED molded links 21 may take a form of an LED light rope that includes the plurality of LED lights 21*a* encased within a transparent tubular-type rope structure.

As stated above, the expandable LED light ball 20 is connected to the control box 10, which includes the light control switch 15 that can control the LED lights 21*a* to change color and/or blinking status.

As illustrated in FIG. 1, the winch cord 13 of the control box 10 may be connected to the ball attachment portion 22. The ball attachment portion 22 may be electrically connected to the winch cord 13 of the control box 10, so that power and information may be provided from the light control switch 15 to the expandable LED light ball 20.

Figure 3:
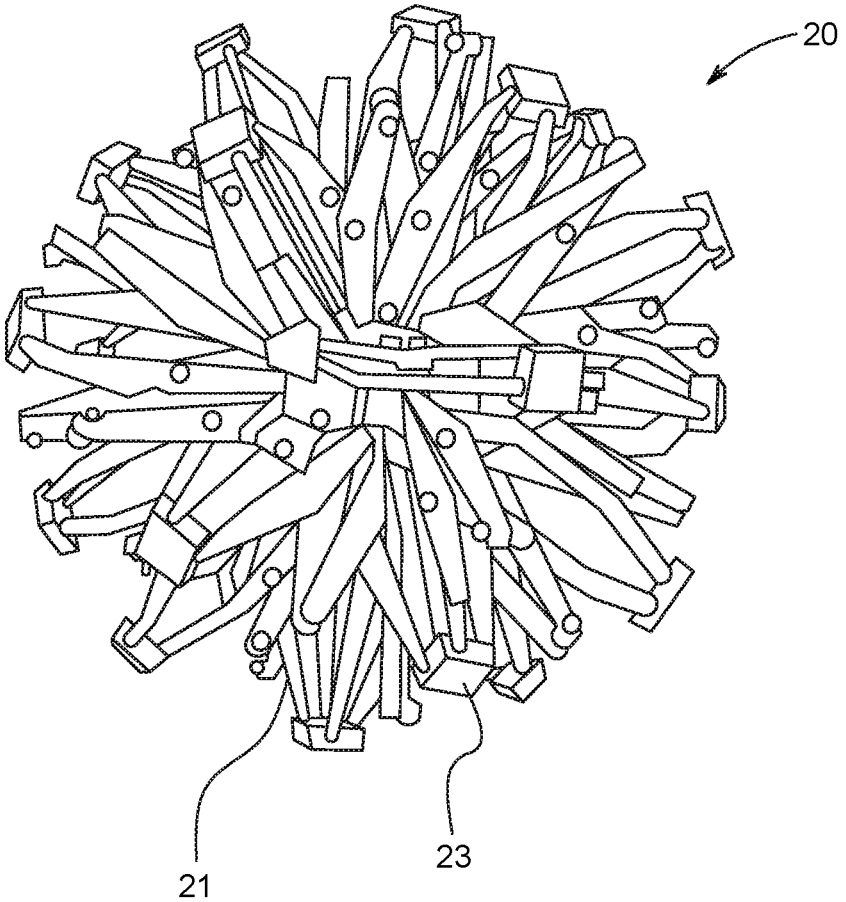
FIG. 3 illustrates the expandable LED light ball in a contracted state, according to an exemplary embodiment of the present general inventive concept.

FIG. 3 illustrates the expandable LED light ball 20 in a contracted state, according to an exemplary embodiment of the present general inventive concept.

As stated above, the expandable LED light ball 20 may be expanded and contracted. Referring to FIGS. 1 and 3, it is clear that the LED molded links 21 are designed to expand and contract in an accordion-like manner. More specifically, various portions of the LED molded links 21 converge at various converging points 23. The converging points 23 act as stable stationary points where various portions of the LED molded links 21 converge, in order to allow the LED molded links 21 to expand during display-use, and contract for storage facilitation of the expandable LED light ball 20.

The present general inventive concept of the expandable LED light ball 20 may be utilized during holiday seasons, and may optionally be included in plurality and interconnected in a manner similar to Christmas lights. As such, the light control switch 15 may control the plurality of expandable LED light balls 20.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An expandable light emitting diode (LED) light system, comprising:

an expandable LED light ball, comprising:

a plurality of movable LED molded links including a plurality of LED lights disposed thereon or therein; and a control box to control the expandable LED light ball.

2. The expandable LED light system of claim 1, wherein the control box comprises:

a winch cable connected to the expandable LED light ball;

a winch to unwind and retract the winch cable;

a motor to rotatably move the winch; and a motor control switch to control the motor and a direction in which the winch rotates.

3. The expandable LED light system of claim 2, wherein control box further comprises:

a light control switch connected to the winch cable to control a color-changing of the expandable LED light ball.

4. The expandable LED light system of claim 1, wherein the expandable LED light ball comprises:

a plurality of converging points connected to various portions of the plurality of LED molded links.

5. The expandable LED light system of claim 1, wherein the plurality of LED molded links are expandable and contractable in an accordion-like manner.

* * * * *